US008627926B2

(12) United States Patent
Gordon

(10) Patent No.: US 8,627,926 B2
(45) Date of Patent: Jan. 14, 2014

(54) METHOD AND APPARATUS FOR A STAIR ASSEMBLY

(76) Inventor: Julian D. Gordon, Marblehead, MA (US)

( * ) Notice: Subject to any disclaimer, the term of this patent is extended or adjusted under 35 U.S.C. 154(b) by 284 days.

(21) Appl. No.: 12/469,781

(22) Filed: May 21, 2009

(65) Prior Publication Data

US 2010/0294593 A1 Nov. 25, 2010

(51) Int. Cl.
*E06C 7/16* (2006.01)

(52) U.S. Cl.
USPC ..... 182/115

(58) Field of Classification Search
USPC ..... 182/115, 116, 82, 83; 14/71.1; 256/73; 52/182, 183, 188, 191, 8
See application file for complete search history.

(56) References Cited

U.S. PATENT DOCUMENTS

| | | | | | |
|---|---|---|---|---|---|
| 2,936,863 | A * | 5/1960 | Holzer | 52/191 |
| 3,092,383 | A * | 6/1963 | Dunn | 482/30 |
| 3,529,695 | A * | 9/1970 | Rowley | 182/115 |
| 3,593,821 | A * | 7/1971 | Lister | 182/115 |
| 3,693,754 | A * | 9/1972 | Butler | 182/86 |
| 3,788,016 | A * | 1/1974 | Richardson | 52/66 |
| 3,808,757 | A * | 5/1974 | Greenwood | 52/184 |
| 3,909,997 | A * | 10/1975 | Eickhof | 52/188 |
| 4,185,716 | A * | 1/1980 | Rinehart | 182/2.5 |
| RE30,830 | E * | 12/1981 | Wenger et al. | 182/113 |
| 4,359,793 | A * | 11/1982 | Hosono | 5/100 |
| 4,747,243 | A * | 5/1988 | Anstead | 52/184 |
| 4,759,162 | A * | 7/1988 | Wyse | 52/126.6 |
| 4,979,340 | A * | 12/1990 | Wilson et al. | 52/9 |
| 4,984,619 | A * | 1/1991 | Ellis | 160/351 |
| 5,014,475 | A | 5/1991 | Anderson, Jr. et al. | |
| 5,189,854 | A | 3/1993 | Nebel | |
| 5,517,708 | A * | 5/1996 | Baranowski | 14/69.5 |
| 5,740,575 | A * | 4/1998 | Gordon | 14/69.5 |
| 5,913,508 | A * | 6/1999 | Eades | 256/65.06 |
| 6,345,475 | B1 * | 2/2002 | Flory | 52/184 |
| 6,698,142 | B2 * | 3/2004 | Denny | 52/8 |
| 6,763,912 | B2 * | 7/2004 | Robinson et al. | 182/115 |
| 6,810,995 | B2 * | 11/2004 | Warford | 182/115 |
| 7,047,698 | B2 * | 5/2006 | Torch | 52/182 |
| 7,309,051 | B2 * | 12/2007 | McNeill | 248/188.2 |
| 7,546,705 | B1 * | 6/2009 | Rivera et al. | 52/10 |
| 7,621,236 | B2 * | 11/2009 | Steffey et al. | 119/847 |
| 2006/0272230 | A1 * | 12/2006 | Elwood | 52/182 |
| 2007/0051934 | A1 * | 3/2007 | LaCook | 256/73 |
| 2008/0035424 | A1 | 2/2008 | Klockler et al. | |
| 2009/0056245 | A1 | 3/2009 | Miller | |
| 2009/0249713 | A1 * | 10/2009 | Rivera et al. | 52/183 |

OTHER PUBLICATIONS

International Search Report and Written Opinion in corresponding PCT application US/10/01506 filed May 21, 2010.

* cited by examiner

*Primary Examiner* — Katherine Mitchell
*Assistant Examiner* — Johnnie A Shablack
(74) *Attorney, Agent, or Firm* — Wolf, Greenfield & Sacks, P.C.

(57) ABSTRACT

A reusable stair system may allow for access to a platform, for example, at the top of a ramp so that able people are not required to travel the entire distance of the ramp to reach the main platform. The reusable stair system can be easily assembled and disassembled, having a number of legs that are attached to adjacent stairs. Legs may have two attachment regions for two stairs on either side of each leg and one of the stairs being located at a greater height than the other stair. The desired height of the main platform at the top of the stair system will determine the number of legs and corresponding stairs that will be used.

19 Claims, 21 Drawing Sheets

METHOD AND APPARATUS FOR A STAIR ASSEMBLY

BACKGROUND OF INVENTION

1. Field of Invention

Systems and methods for assembly of a stair system are generally disclosed.

2. Discussion of Related Art

Stair systems having different modules and components that can be connected together to form reusable stair assemblies may be used for various applications. Prefabricated stair assemblies are commonly designed for a single application or a particular use. For example, stair assemblies may be prefabricated for new homes, trailer homes, handicap ramps, etc. Such stair assemblies are typically constructed of cement or other heavy material, making them difficult to transport, position, and secure in place. Removal of such stair assemblies requires a significant amount of labor and often requires special equipment.

Ramp systems have been manufactured for the disabled as well as for the general population in crossing difficult terrain such as steep, icy driveways, steps, etc. Approximately 45% of wheelchair ramps are rented, with use lasting about 5-6 months. Use of such ramps typically arise from injuries of a temporary nature. Permanent ramps made from wood or concrete, for example, are costly, require building permits, and reduce the value of a residence upon resale. Sometimes, permanent ramps are not readily available so as to meet hospital discharge schedules. Ramps, such as that described in U.S. Pat. No. 5,740,575, that are modular in construction so as to enable a number of ramp sections to be connected end to end to suit any application have been contemplated. However, when such a ramp is set up leading to a platform, people who do not use wheelchairs are often required to use the ramp leading to the platform (e.g., to enter a home or trailer). Placement of the ramp often prevents use of existing stairs that may lead directly into the home. As a result, use of a ramp could mean considerably more extra steps required for people to enter into a structure.

SUMMARY OF INVENTION

In some cases, a reusable stair system allows access to the main platform at the top of a ramp, so that able people are not required to travel the entire distance of the ramp in order to reach the main platform. The reusable stair system can be easily assembled and disassembled, the system including a number of legs that are attached to adjacent stairs in a simple manner. The desired height of the main platform at the top of the stair system will determine the number of legs and corresponding stairs that will be used. Stairs will be attached to legs at attachment regions of the legs. Legs may have two attachment regions for two stairs, one of the stairs being located at a greater height than the other stair. The uppermost leg will have an attachment region appropriate for attachment to the platform and an attachment region appropriate for attachment to a stair that is positioned lower than the platform when incorporated into the stair system. The lowermost leg will have an attachment region appropriate for attachment to a lowermost stair when incorporated into the stair system.

In an illustrative embodiment, a reusable stair system for use with a platform is provided. The reusable stair system includes a first set of legs attached to the platform at an upper attachment region of the first set of legs, the first set of legs extending downwardly from the platform and each having a base that is disposed on a surface on which the stair system is to be assembled; a first stair having a front edge and a rear edge, the first stair being attached at the rear edge to a lower attachment region of the first set of legs at a first distance below a plane defined by the platform; a second set of legs attached at a second upper attachment region of the second set of legs to the front edge of the first stair, the second set of legs extending downwardly from the first stair and each including a base also disposed on the surface on which the stair system is to be assembled; a second stair having a front edge and a rear edge, the second stair being attached at the rear edge to a lower attachment region of the second set of legs at a second distance below a plane defined by the first stair; and a third set of legs attached at a third upper attachment region of the third set of legs to the front edge of the second stair, the third set of legs extending downwardly from the second stair and each including a base that is also disposed on the surface on which the stair system is to be assembled.

In another illustrative embodiment, a reusable stair assembly is provided. The reusable stair assembly includes a platform having a surface for access by the stair assembly; a first set of legs detachably connected its upper attachment region to a side of the platform for access by the stair assembly and extending downwardly to a ground surface from which access occurs, said first set of legs including a base that is disposed on the ground surface; a first stair having a front edge and a rear edge, the rear edge of the first stair being detachably connected to a lower attachment region of the first set of legs at a distance below the platform; and at least one additional set of legs having an upper attachment region attached to the front edge of the additional stair as described in connection with the first stair above, wherein the additional stair comprises a lowermost stair disposed within stepping access of the ground surface.

Other advantages and novel features of the invention will become apparent from the following detailed description of various non-limiting embodiments when considered in conjunction with the accompanying figures and claims.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
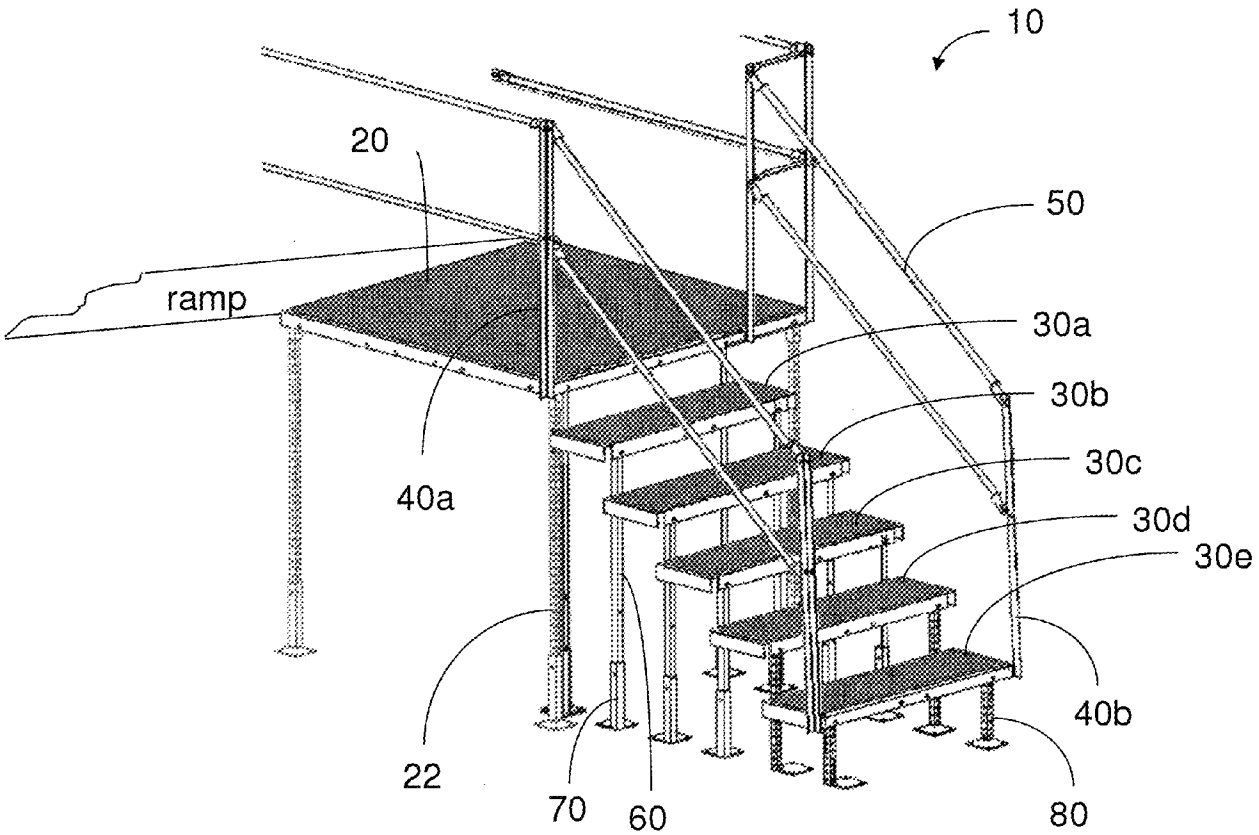
FIG. 1 is a perspective view of a reusable stair system in accordance with aspects of the invention.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

In various embodiments, reusable stair systems may allow for easy access to the main platform located, for example, at the top of a ramp, so that able people are not required to travel the entire distance of the ramp in order to reach the main platform. Reusable stair systems described herein can be easily assembled and disassembled according to a desired height for a top platform. A number of legs are attached to adjacent stairs in an effective manner with the length of each leg corresponding to the approximate height of adjacent stairs on either side of the legs. In some embodiments, legs have an upper attachment region for one stair and a lower attachment region for another stair, the former stair being located at a height that is greater than the height of the latter stair. In some cases, the uppermost leg of the stair system will have an attachment region appropriate for attachment to the platform and an attachment region appropriate for attachment to a stair that is positioned a stepping distance below the platform. In some cases, the lowermost leg will have an attachment region appropriate for attachment to a lowermost stair when incorporated into the stair system. Generally, the rear edge of a stair may be attached to an attachment region below the top of a taller leg and the front edge of a stair may be attached to an attachment region that is lower at or closely adjacent the top of the shorter leg.

In some embodiments, legs may have any number of attachment regions. For example, legs may be perforated throughout their full length or only at selected portions of their length. In some embodiments, legs may be separately attachable to bases having base plates for contacting the ground. In some embodiments, legs may already incorporate bases, allowing for the legs to be positioned upright without further attachment.

In some cases, mounting brackets may allow for rails to be incorporated in the stair system. Rails may prevent someone from falling to either side while traveling over the stair system. Also, rails may also be grasped for support by a user when traveling over the stair system. In some embodiments, a mounting bracket may be attached to the platform and a mounting bracket may be attached to the lowermost stair with rails being suitably attached at their ends to the mounting brackets. A gate system may also be optionally included at the main platform level and/or at the lowermost stair. The gate system, when installed, may be opened or closed, allowing for ingress and egress to and from the stair system. If a gate system is provided, appropriate mounting brackets may be used that are suitable for gate assembly with the reusable stair system.

One of skill will appreciate that when an article is "attached" to another article or an "attachment" is made between two articles, the articles are firmly secured. In some cases, articles attached to one another may be detachably connected and disassembled as they are not permanently secured to one another. For example, a rail with a hole may be attached to a post with a hole by use of a bolt and nut arrangement through holes in both the rail and the post, or a threaded screw arrangement may also be used to attach the two articles together. In some cases, articles attached to one another are permanently secured, for example, through welding, fusing, and/or unitary formation.

FIG. 1 depicts an illustrative embodiment of a reusable stair system 10 having a platform 20 that is supported by platform legs 22. Steps leading up to the platform 20 include stairs 30*a*, 30*b*, 30*c*, 30*d*, and 30*e*. In the embodiment depicted, stairs are supported by legs 60 that include corresponding bases 70, and/or stairs are supported by perforated legs 80. As shown, the platform 20 and stairs 30*a*, 30*b*, 30*c*, 30*d*, and 30*e* are arranged to be successively lower in height. Legs 60 and perforated legs 80 extend downwardly to the ground from stairs 30*a*, 30*b*, 30*c*, 30*d*, and 30*e* to which the legs 60 and 80 are attached. The illustrative embodiment shown includes a platform, five stairs, and six sets of legs, each set of legs having an appropriate height for the corresponding stair. Mounting brackets 40*a* are attached to the platform 20 and mounting brackets 40*b* are attached to lowermost stair 30*e*. Rails 50 are attached to mounting brackets 40*a* and 40*b*, providing for support or a barrier.

Figure 2:
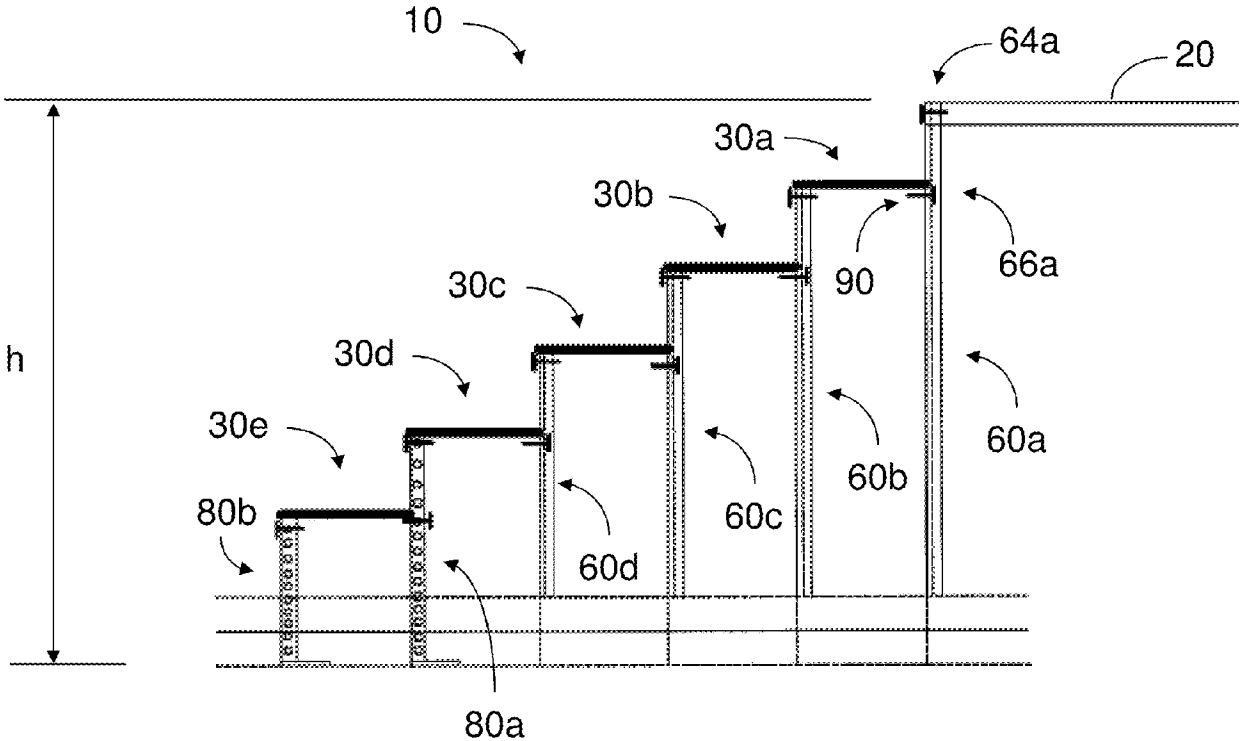
FIG. 2 is a side view of a reusable stair system in accordance with aspects of the invention.

Another illustrative embodiment of a reusable stair system 10 is shown as a side profile in FIG. 2, depicting platform 20 that is a height h above the ground. As shown in FIG. 1, this particular embodiment includes a platform, five stairs, and six sets of legs. It can be appreciated that as height h of the platform can be adjusted according to a desired height, an appropriate number of stairs and legs may be suitably used. In addition, legs shown in FIG. 2 refer to sets of legs. In this regard, leg 60*a*, for example, may include an additional leg provided so that platform 20 or stair 30*a* may be appropriately supported. As shown in FIG. 1, sets of legs include pairs of legs. It can be appreciated that any suitable number of legs (i.e., one or more) may be included in a set of legs.

As depicted in FIG. 2, leg 60*a* is attached to platform 20 at an upper attachment region 64*a* of the leg 60*a* and is also attached to stair 30*a* at a lower attachment region 66*a* of the leg 60*a*. In addition, leg 60*b* is attached to stair 30*a* at an upper attachment region of the leg 60*b* and is also attached to stair 30*b* at a lower attachment region of the leg 60*b*. Leg 60*c* is similarly attached to both stair 30*b* and stair 30*c*, along with leg 60*d* being attached to both stair 30*c* and stair 30*d*. Perforated leg 80*a* is attached to stair 30*d* at an upper attachment region of the perforated leg 80*a* and is also attached to stair 30*e* at a lower attachment region of the perforated leg 80*a*. Similarly, perforated leg 80*b* is attached to stair 30*e*.

It can be appreciated that legs and perforated legs may be attached to the platform and stairs through any suitable manner such as through attachment method 90 which functions to attach leg 60*a* to stair 30*a*, as shown in FIG. 2. In the embodiment shown, attachment method 90 is a nut and bolt arrangement. Any suitable arrangement may be used for an attachment method 90.

Figure 3:
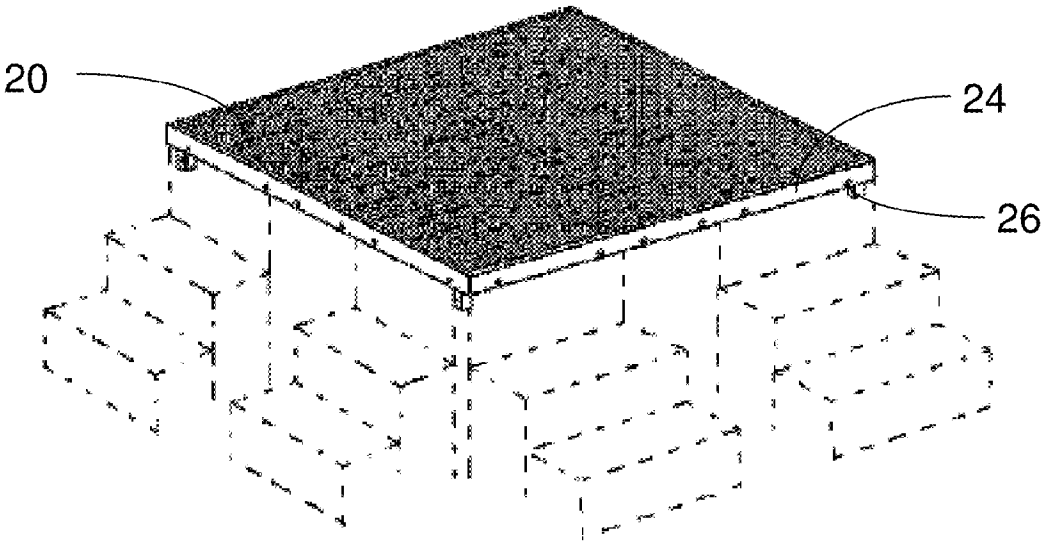
FIG. 3 is a perspective view of a platform with optional locations for stair systems in accordance with aspects of the invention.

FIG. 3 shows a platform 20 along with various configurations where a reusable stair system 10 may be provided with the platform 20 (depicted by the dotted lines). As shown, a stair system may include steps that are attached at any appropriate location of the platform 20, for example, preferably at a corner of the platform. Platform 20 includes a side edge 24 and an platform attachment region 26, which provide for a reusable stair system to be suitably assembled, as will be described in more detail below.

Figure 4:
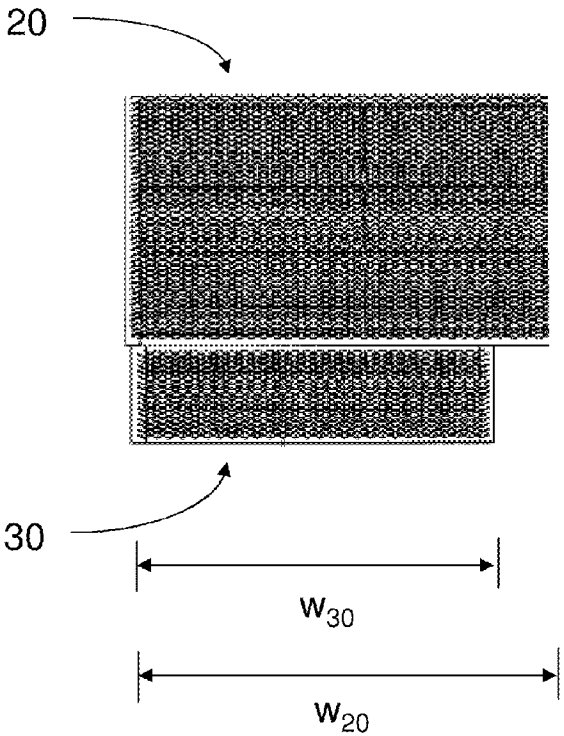
FIG. 4 is a top view of a platform and a stair in accordance with aspects of the invention.

FIG. 4 depicts a top view of a platform 20 attached to a stair 30 where the width $w_{30}$ of the stair 30 is less than the width $w_{20}$ of the platform 20. It can be appreciated that the width $w_{30}$ of the stair 30 is not required to be less than the width $w_{20}$ of the platform. In fact, for some embodiments not shown, the width $w_{30}$ of the stair 30 is equal to or greater than the width $w_{20}$ of the platform. Any suitable surface may be provided on top of a platform 20 and/or a stair 30. For example, in some embodiments, the top surface of a platform 20 and/or a stair 30 may include an appropriate tread, or may be relatively smooth, and may be perforated or solid. In some embodiments, the top surface of a platform 20 and/or a stair 30 may include any suitable material or combination of materials. The platform 20 and stairs 30 may be made of a similar or different material and/or construction. For example, they may be made of metal such as steel or aluminum or both, and their frames may be of one material and their support surfaces another.

Figure 5:
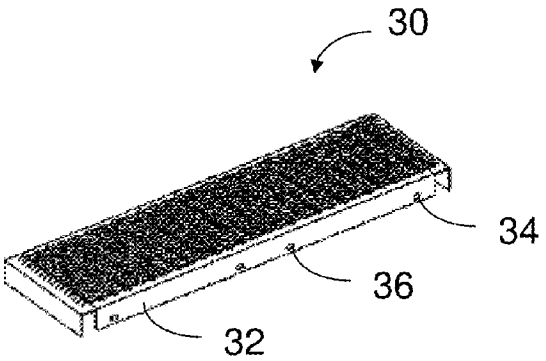
FIG. 5 is a perspective view of a stair in accordance with aspects of the invention.

An illustrative embodiment of a stair 30 is shown in FIG. 5. Stair 30 includes a front edge 32 along with stair attachment regions 34 and 36. In this embodiment, stair attachment regions 34 and 36 are provided in the form of attachment holes where any suitable attachment arrangement may be used in attaching the stair 30 to a suitable article such as, for example, a leg or a mounting bracket. Other stair attachment regions are also shown, though not explicitly labeled. Although not shown, stair 30 includes a back edge with respective stair attachment regions in addition to front edge 32.

Figure 7:
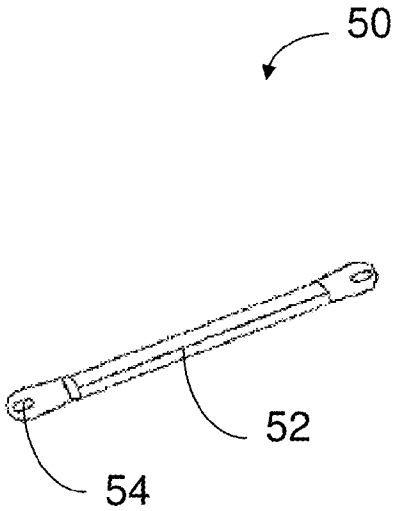
FIG. 7 is a perspective view of a rail in accordance with aspects of the invention.
Figure 6:
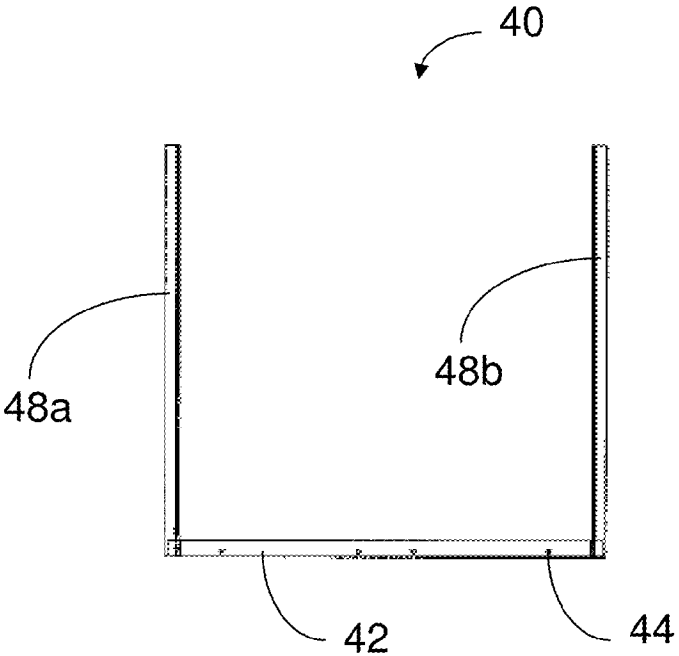
FIG. 6 is a side view of a mounting bracket in accordance with aspects of the invention.

FIGS. 6 and 7 show illustrative embodiments of a mounting bracket 40 and a rail 50 for attachment to the mounting bracket 40. Depicted in FIG. 6, the mounting bracket 40 includes a main bracket portion 42 that connects side bracket portions 48*a* and 48*b* together. Bracket attachment region 44 is also shown in main bracket portion 42 along with other attachment regions that are not explicitly labeled. In the embodiment illustrated, the attachment regions are holes in bracket base 42. A mounting bracket 40 may be attached to a platform 20 and/or an appropriate stair 30, for example, a lower or lowermost stair. It can be appreciated that different portions of the mounting bracket 40 may be made from different material and/or construction. For example, the main bracket portion 42 may be formed with bracket sides 48*a* and 48*b* as a single unitary piece or the main bracket portion 42 may be formed separately from sides 48*a* and 48*b*. Although not explicitly shown, bracket sides 48*a* and 48*b* may include regions that allow for attachment of, for example, a rail 50 as shown in FIG. 7. Rail 50 includes a rail body 52 and an attachment regions 54 for attachment to, for example, a bracket side 48. As depicted in FIG. 1, the optional combination of mounting brackets 40*a* and 40*b* along with rails 50 may provide for a suitable support in ascending or descending an assembled stair system.

Figure 8:
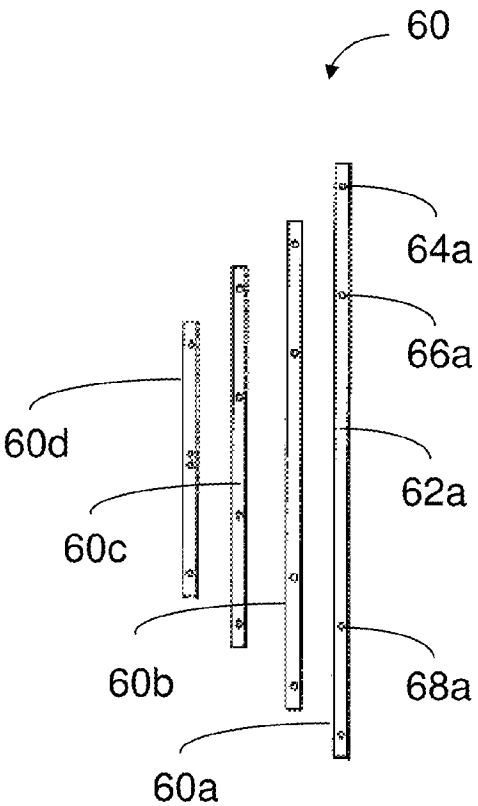
FIG. 8 is a side view of four legs of varying lengths in accordance with aspects of the invention.

FIG. 8 shows an illustrative embodiment of four legs 60*a*, 60*b*, 60*c*, and 60*d*, of varying lengths. The legs have different lengths according to how high corresponding stairs are desired to be and where legs and stairs will attach. As shown in FIG. 8, for example, leg 60*a* includes a leg body 62*a* along with upper attachment region 64*a* and lower attachment region 66*a* for attachment of a stair or a platform. Leg 60*a* also includes base attachment region 68*a* which is lower than lower attachment region 66*a*. It should be understood that upper, lower, and base attachment regions are considered with respect to distance from the ground. It can be appreciated that the legs in the embodiment shown are reversible, so that different attachment regions may serve as upper and lower attachment regions. For example, if leg 60*a* is turned upside down, then the unlabeled attachment region would be considered to be the upper attachment region. Of course, such a configuration that supports this reversal of orientation is not a required feature. FIG. 8 also depicts legs 60*b*, 60*c*, and 60*d* which are similar to leg 60*a* in that they include upper, lower, and base attachment regions. However, legs 60*b*, 60*c*, and 60*d* are different in overall length and may be used based upon the desired stair height that is attached to the corresponding leg. It can be appreciated that a leg may be formed as a single unitary piece or may be formed as separate elements that can be pieced together into a leg of appropriate length.

Figure 9:
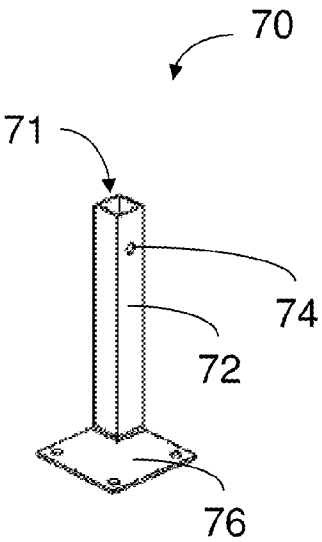
FIG. 9 is a perspective view of a leg base in accordance with aspects of the invention.

FIG. 9 depicts an illustrative embodiment of a base 70 that includes a leg insertion sleeve 71, a base body 72, a attachment region 74, and a base plate 76. In this embodiment, any of legs 60 shown in FIG. 8 may be appropriately attached to a base 70 so that the leg 60 may be placed in an upright position. For example, a leg 60 may be placed loosely into the sleeve 71 of base 70 and then suitably attached. Base plate 76 provides a suitable surface for contacting the ground and supporting the stair structure assembled above. It should be understood that legs are not required to have corresponding bases. Indeed, legs may be formed as a unitary piece including a base plate such that separate attachment to a base is not necessary. However, it may be advantageous to include a base 70, as the height of a leg 60 may be appropriately adjusted. While not explicitly shown, it can be appreciated that legs 60 and bases 70 may have multiple attachment regions 68 and 74, respectively. Adjustment of a leg 60 within a base 70 may occur, for example, if the leg 60 that is attached to a particular stair is not of a suitable corresponding height. In some cases, the ground underneath the stair system may be soft or uneven and so height adjustment may be beneficial.

Figure 10:
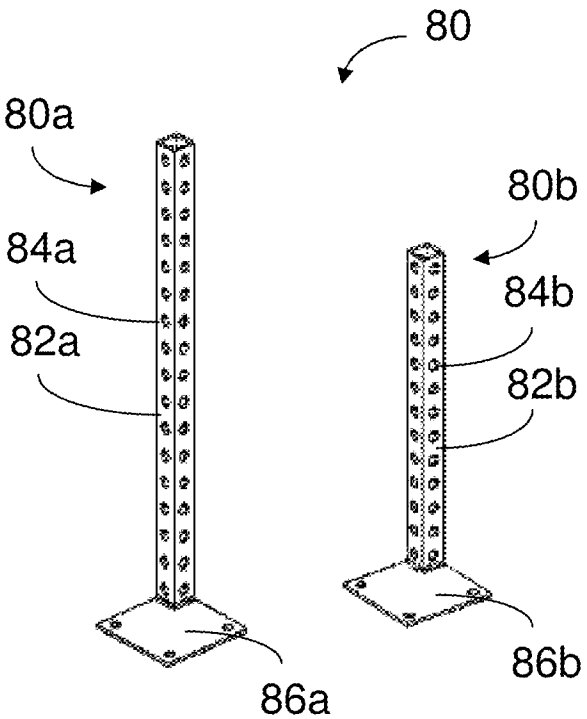
FIG. 10 is a perspective view of two perforated tubular legs of varying lengths in accordance with aspects of the invention.

FIG. 10 shows another illustrative embodiment of two perforated legs 80*a* and 80*b*. Perforated legs 80*a* and 80*b* include perforated leg bodies 82*a* and 82*b*, wherein the perforations define leg attachment regions 84*a* and 84*b*, and perforated base plates 86*a* and 86*b*, respectively. In the embodiments shown, perforated legs 80*a* and 80*b* differ in length based on the height at which stairs 30 may be attached to the perforated legs 80. In contrast to the legs 60 depicted by FIGS. 8 and 9, perforated legs 80 include significantly more attachment regions, depicted by holes, along the length of the leg bodies, which may provide for increased tunability as to how high the stairs 30 may be attached to the perforated legs 80. In addition, perforated legs 80 already include bases that have perforated leg base plates 86, in contrast to the embodiment of FIGS. 8 and 9 that show a separate base 76 attached to each leg 60. In FIG. 10, bases with perforated leg base plates 86 are formed unitarily with perforated legs 80 and allow for the perforated legs 80 to be placed in a suitably upright position without having to attach a separate base portion to it. However, although not shown, it can be appreciated that perforated legs 80 may be manufactured so as to include separate bases corresponding to each perforated leg, similarly to bases 70 corresponding to legs 60 in FIGS. 8 and 9. The legs 80*a* and 80*b* are tubular and square in cross section and typically may be made of mild steel or aluminum.

Figure 11B:
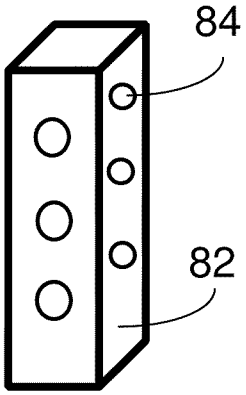
FIG. 11B is a perspective view of a square shaped tubular leg in accordance with aspects of the invention.
Figure 11A:
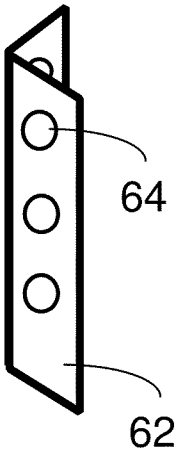
FIG. 11A is a perspective view of a "L" shaped leg in accordance with aspects of the invention.

As depicted by FIGS. 11A and 11B, legs may have various appropriate shapes. In some embodiments, shown in FIG. 11A, a leg body 62 may be L-shaped in cross section. Attachment regions 64 are also shown. Legs 60, depicted in FIG. 8 are also L-shaped cross sections. In the embodiment shown in FIG. 11B, leg body 82 is tubular and has a square cross section and preferably is made of mild steel or aluminum. Attachment regions 84 that correspond to the leg body 82 are shown as well. It can be appreciated that any suitable shape cross section may be used for leg bodies. For example, cross sectional shapes of leg bodies may be circular, elliptical, polygonal, "V" shaped, curved, contoured, irregular shaped, and/or combinations thereof.

For the embodiment shown in FIGS. 1 and 2, two sets of perforated legs 80 and four sets of legs 60 were used for five stairs 30 and a platform 20. It should be understood that for a reusable stair system 10, any number and combination of legs 60 and perforated legs 80 may be utilized. During assembly of the stair system, although shown, it is not required, for example, for perforated legs 80 to be attached to the lowermost stairs and for legs 60 to be attached to the uppermost stairs (and the platform). Additionally, any combination of legs 60 or perforated legs 80 may be included in a set of legs corresponding to a particular stair at a particular height. Indeed, legs 60 and perforated legs 80 may be appropriately interchangeable, depending upon the anticipated load to which the stairs will be subjected and the cost of the different types of legs.

The height and size of the stairs and platform may determine the number of sets of legs (e.g., could include any suitable combination of legs with bases as well as perforated legs) and the number of stairs used. Typically, the steps may be approximately 7 inches from one another. Where a platform includes one stair, the platform height may be about 14 inches above the ground. It can be appreciated that with each added stair, the platform height will be raised accordingly.

Figure 13:
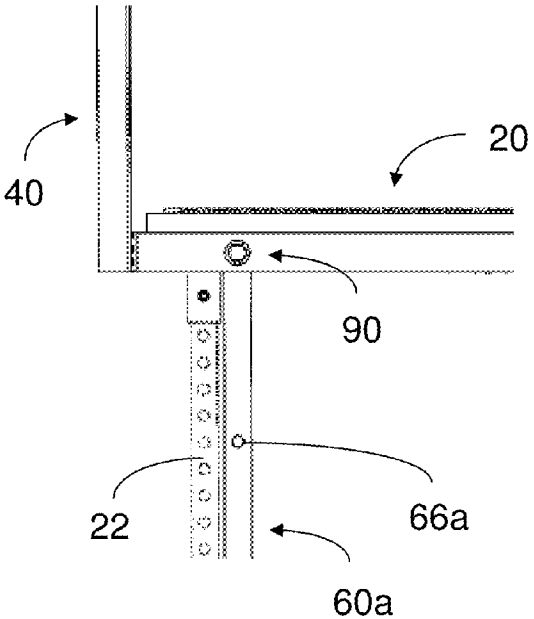
FIG. 13 is a front view of the embodiment depicted in FIG. 12 in accordance with aspects of the invention.
Figure 12:
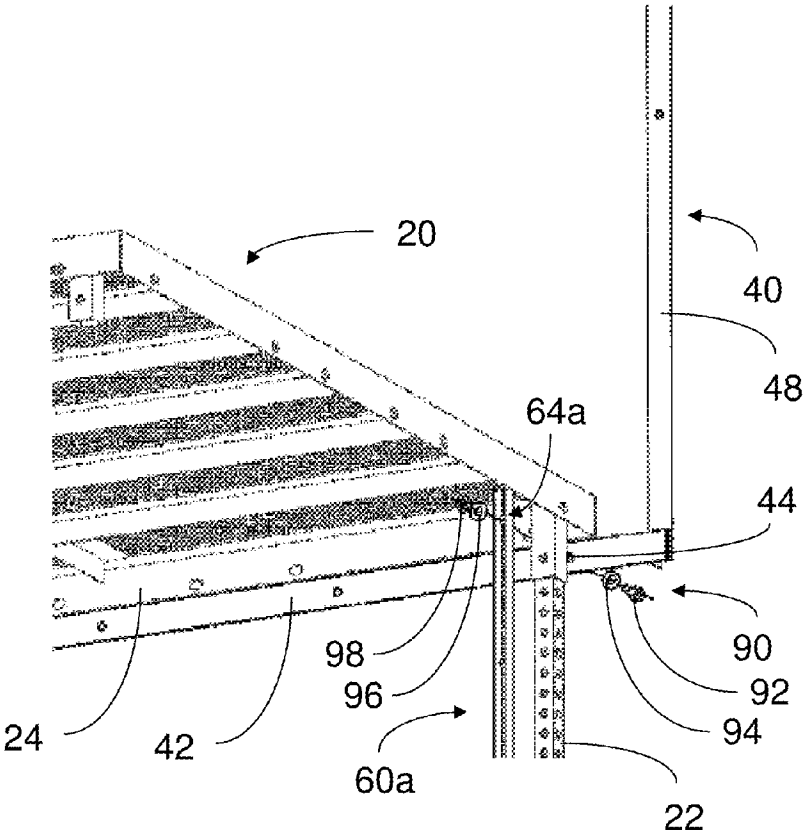
FIG. 12 is a fragmentary perspective view of a leg and a mounting bracket being attached to a platform in accordance with aspects of the invention.

FIGS. 12-17 show steps by which an exemplary reusable stair system 10 as depicted in FIGS. 1 and 2 may be assembled. FIG. 12 depicts a first step of stair assembly in a perspective view from below, beginning with the platform 20 at the top of the stair system 10. The platform 20 may already be assembled, for example, in a ramp assembly, and as shown by platform leg 22. As illustrated, mounting bracket 40 and the tallest leg 60*a* are attached to the platform 20 through use of an attachment method 90, which includes a bolt 92, a bolt washer 94, a nut washer 96, and a nut 98. The bolt 92 slides through attachment region 44 of mounting bracket 40 and upper attachment region 64*a* of the tallest leg 60*a* and engages with nut 98 for attachment to the platform 20. Bolt washer 94 and nut washer 96 are also optionally included. The main bracket portion 42 is located immediately adjacent to the front side 24 of the platform 20 once the mounting bracket 40, the tallest leg 60*a*, and the platform 20 are appropriately attached. FIG. 13 depicts a front view of the attachment, showing platform leg 22 disposed adjacent to leg 60*a*. As depicted, although leg 60*a* is attached at upper attachment region 64*a* to the platform 20 and mounting bracket 40, leg 60*a* is not yet attached to a corresponding stair 30 at lower attachment region 66*a*.

Figure 14:
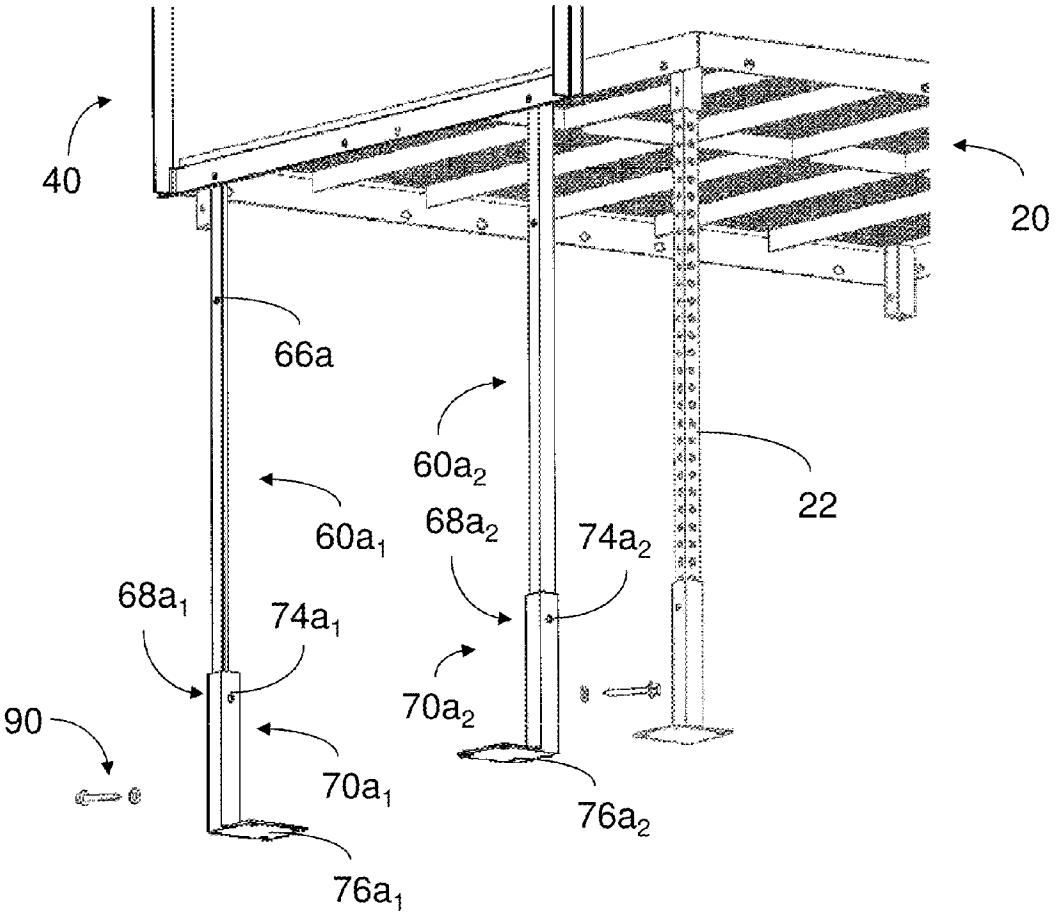
FIG. 14 is a fragmentary perspective view shown from below, of bases being attached to legs in accordance with aspects of the invention.

The first set of legs 60*a* that are attached to platform 20 include legs $\mathbf{60}a_1$ and $\mathbf{60}a_2$, shown in FIG. 14. Once mounting bracket 40 and legs $\mathbf{60}a_1$ and $\mathbf{60}a_2$ are suitably attached to the platform 20, also shown in FIG. 14, bases $\mathbf{70}a_1$ and $\mathbf{70}a_2$ may be attached to legs $\mathbf{60}a_1$ and $\mathbf{60}a_2$ at attachment regions $\mathbf{74}a_1$ and $\mathbf{74}a_2$ and base attachment regions $\mathbf{68}a_1$ and $\mathbf{68}a_2$, respectively, using a suitable attachment method 90. Bases $\mathbf{70}a_1$ and $\mathbf{70}a_2$ include base plates $\mathbf{76}a_1$ and $\mathbf{76}a_2$, for engaging the ground or other surface on which the legs $\mathbf{60}a_1$ and $\mathbf{60}a_2$ stand.

Figure 15:
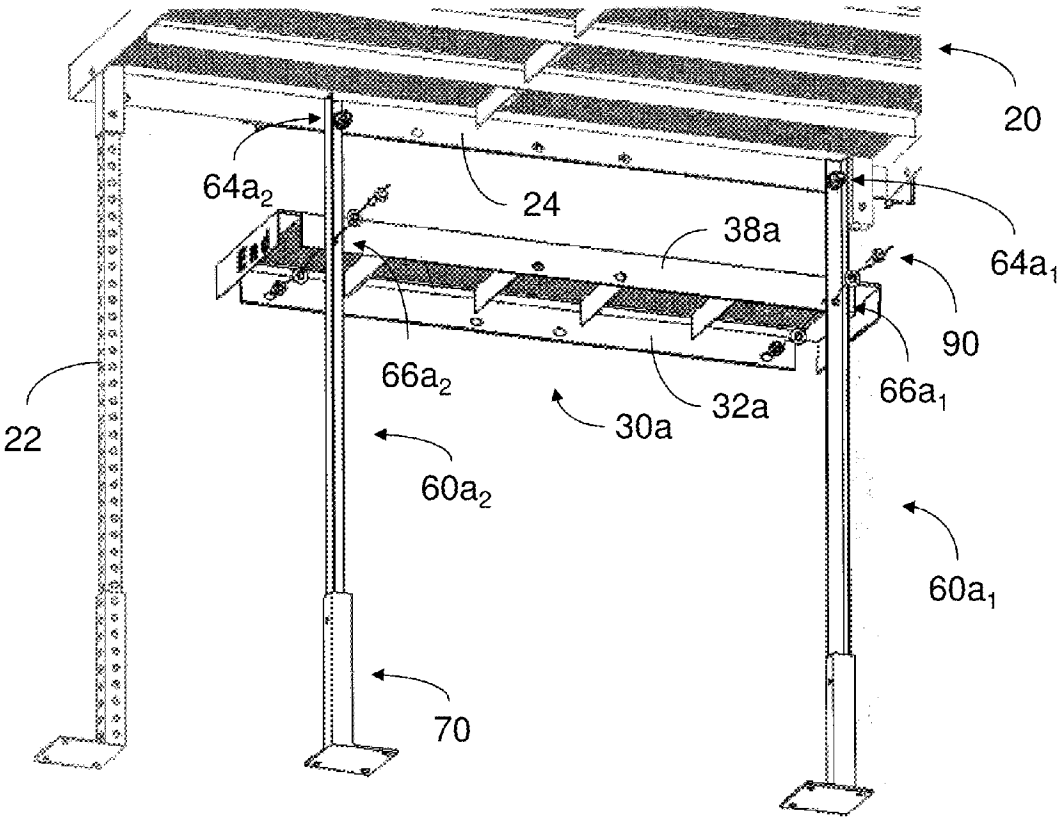
FIG. 15 is a perspective view from below of a stair being attached from its rear side to a pair of legs in accordance with aspects of the invention.

FIG. 15 depicts stair 30*a* being attached to legs $\mathbf{60}a_1$ and $\mathbf{60}a_2$ at the rear edge 38*a* of the stair 30*a* at the lower attachment regions $\mathbf{66}a_1$ and $\mathbf{66}a_2$ of the legs, respectively, using attachment method 90. In addition, legs $\mathbf{60}a_1$ and $\mathbf{60}a_2$, as described above, are attached to platform 20 at the edge 24 of the platform 20 at the upper attachment regions $\mathbf{64}a_1$ and $\mathbf{64}a_2$ of the legs, respectively.

In the illustrative embodiment depicted, although not shown, legs 60*b*, 60*c*, and 60*d* as well as stairs 30*b*, 30*c*, and 30*d* are similarly included in assembly of the stair system as shown in FIGS. 12-15. More specifically, and as shown in FIG. 2, the upper attachment regions of legs 60*b* are attached to the front edge of the stair 30*a* while the lower attachment regions of legs 60*b* are attached to the rear edge of the stair 30*b*. Similarly, the upper attachment regions of legs 60*c* are attached to the front edge of the stair 30*b* while the lower attachment regions of legs 60*c* are attached to the rear edge of the stair 30*c*. And furthermore, the upper attachment regions of legs 60*d* are attached to the front edge of the stair 30*c* while the lower attachment regions of legs 60*d* are attached to the rear edge of the stair 30*c*.

Figure 16:
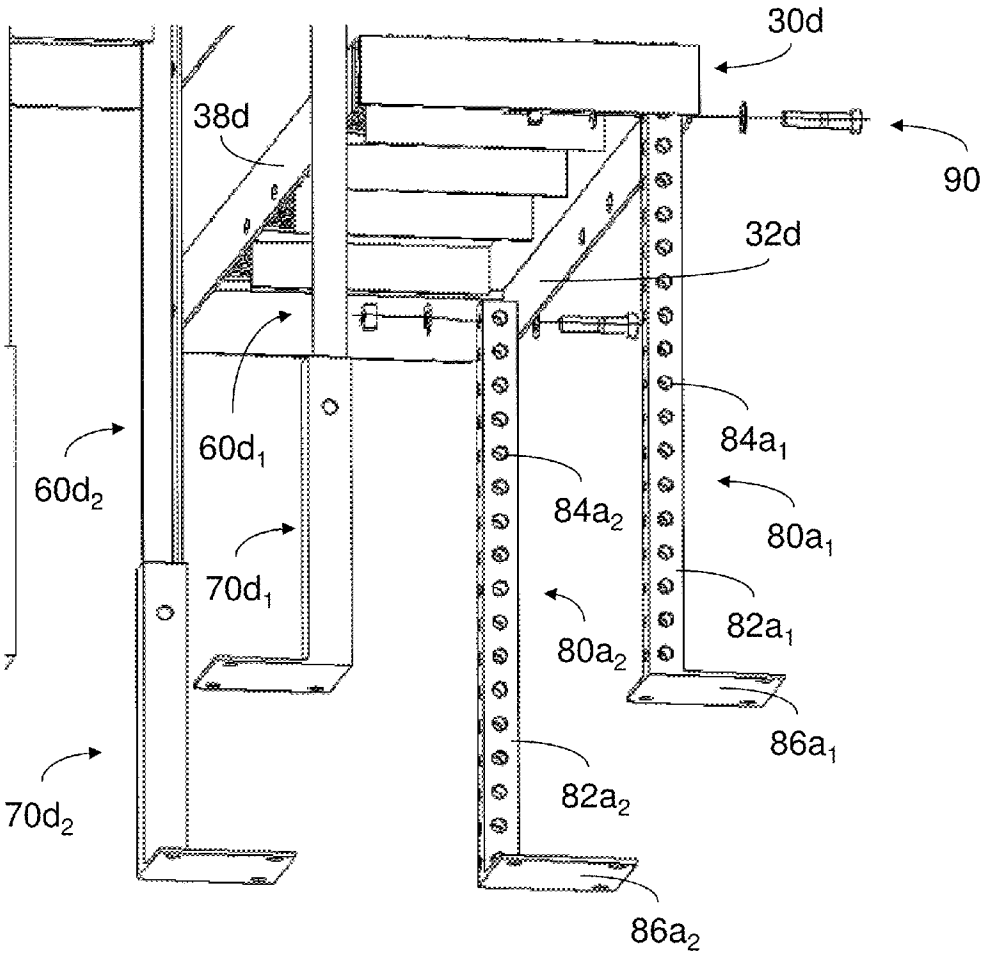
FIG. 16 is a perspective view from below of perforated legs being attached to the front side of a stair in accordance with aspects of the invention.

FIG. 16 shows the rear edge 38*d* of stair 30*d* being attached to lower attachment regions of legs $\mathbf{60}d_1$ and $\mathbf{60}d_2$. Additionally, the front edge 32*d* of stair 30*d* is attached to perforated legs $\mathbf{80}a_1$ and $\mathbf{80}a_2$ at appropriate upper areas of perforated leg attachment regions $\mathbf{84}a_1$ and $\mathbf{84}a_2$, using attachment method 90. Perforated leg bodies $\mathbf{82}a_1$ and $\mathbf{82}a_2$ and leg bases $\mathbf{86}a_1$ and $\mathbf{86}a_2$ provide structure so that perforated legs $\mathbf{80}a_1$ and $\mathbf{80}a_2$ are able to remain in a suitable upright position in supporting the stair system. As described previously, any suitable leg may be used for providing support to associated stairs, including but not limited to legs 60 and/or perforated legs 80 described.

Figure 17:
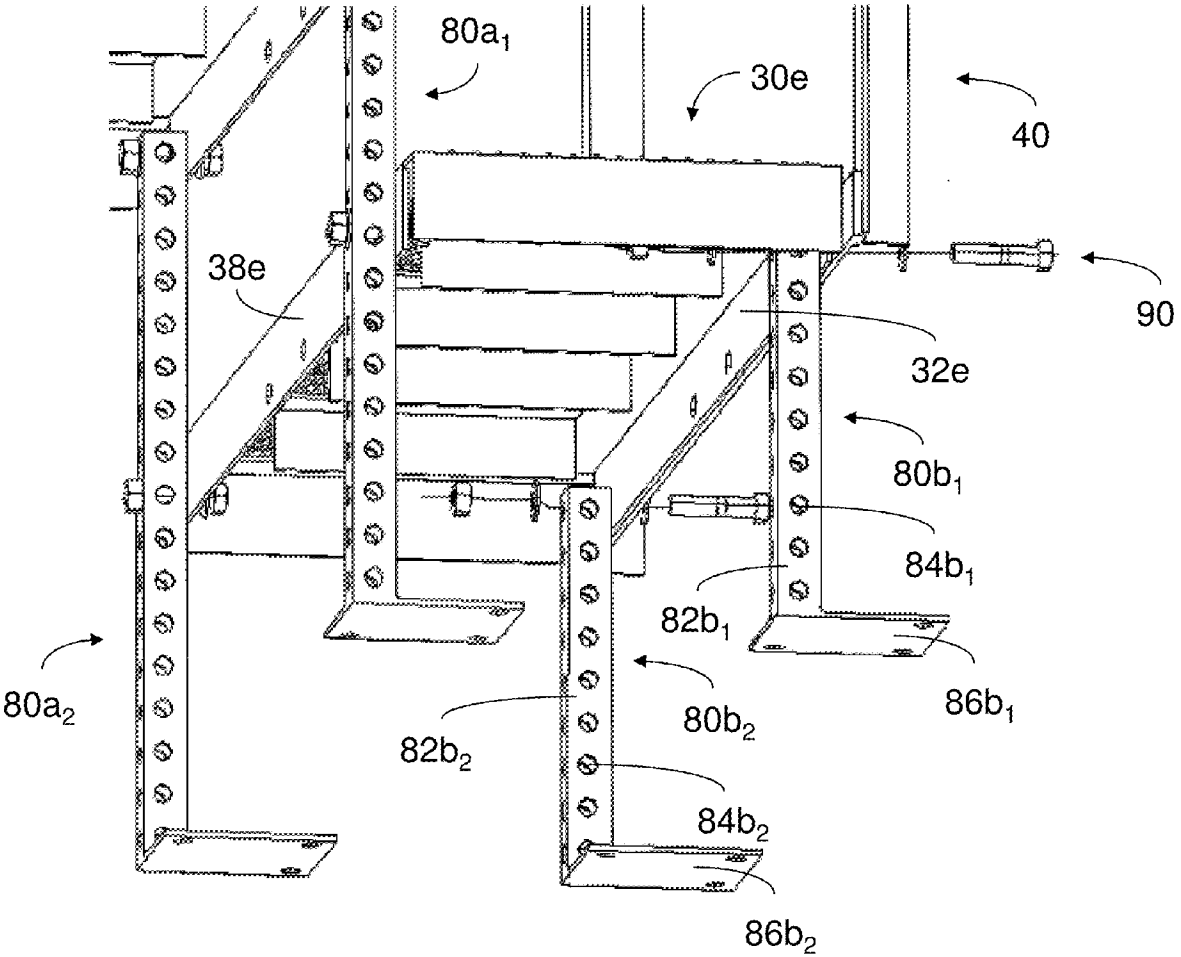
FIG. 17 is a perspective view from below of two perforated legs being attached to another stair in accordance with aspects of the invention.

FIG. 17 depicts the rear edge 38*e* of stair 30*e* attached to legs 80$a_1$ and 80$a_2$ at appropriate lower areas of perforated leg attachment regions. The front edge 32*e* of stair 30*e* is attached to perforated legs 80$b_1$ and 80$b_2$ using attachment method 90. Perforated leg bodies 82$b_1$ and 82$b_2$ and perforated leg base plates 86$b_1$ and 86$b_2$ provide structure so that perforated legs 80$b_1$ and 80$b_2$ are able to remain in a suitable upright position in supporting the stair assembly.

Once assembled, a reusable stair system may be used for whatever length of time is desired. In some embodiments, the reusable stair system is assembled along with a ramp, sharing the same main platform. In some embodiments, the reusable stair system is assembled independently of a ramp. When it is no longer desired for the reusable stair system to be in place, the various parts of the stair system may be easily disassembled. Legs and stairs may be disassembled from one another, for example, by releasing the attachment arrangements that are used to assemble the parts together.

It may be desirable for a gate system to be provided for the platform. In some embodiments, once a stair system is assembled in connection with a platform, an added gating feature that can be opened and closed may be provided for access between the stair system and the platform to be temporarily restricted. A gate system may be assembled before, after, or simultaneously with assembly of the stair system.

Figure 18:
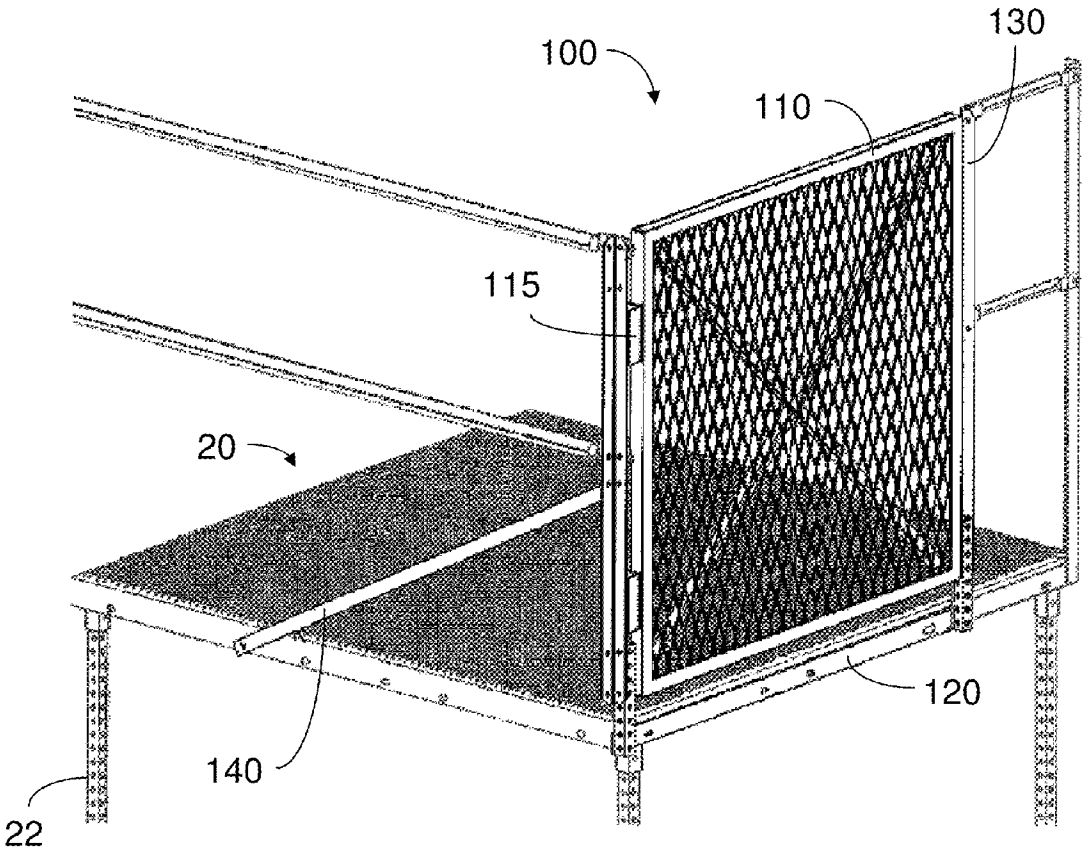
FIG. 18 is a perspective view of a gate attached to a platform in accordance with aspects of the invention.

FIG. 18 depicts an illustrative embodiment of a gate system 100 associated with a platform 20. The gate system 100 includes a gate 110, a gate mounting bracket 120 and a gate rail post 130. A brace 140 is also shown, providing an optional added support. In the gate system 100 shown, the gate 110 may be pivoted about hinges 115 to open and/or close the gate. The gate system may be designed for gate 110 to swing either inwardly or outwardly with respect to the platform. Additionally, for some embodiments, a gate system may be located at a lowermost stair rather than, or in addition to, at the main platform.

Gate system 100 may be opened or closed in any appropriate manner. Gate system 100 may be closed by aligning the gate 110 substantially parallel with an adjacent edge of the platform. Gate 110 and/or gate rail post 130 may include any suitable latch, stop, or other appropriate arrangement so as to preferably hold the gate closed, when desired. In some embodiments, a latching arrangement may need to be physically released to open the gate. In some embodiments, the gate 110 is arranged so that it naturally closes. In some embodiments, gate body 110 is electromechanically remotely controlled through radio frequency, wireless transmission, or the like.

Figure 20:
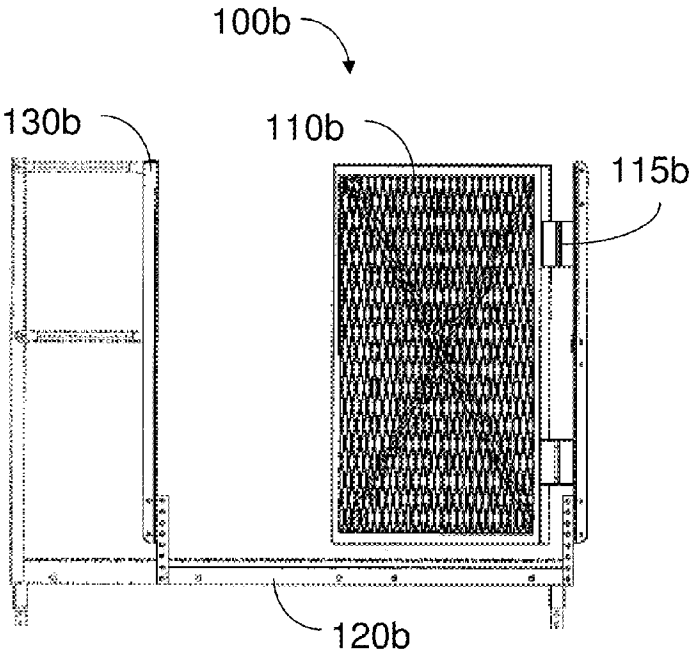
FIGS. 19 and 20 are side views of a gate attached on its left and right sides, respectively, to a platform, in accordance with aspects of the invention.
Figure 19:
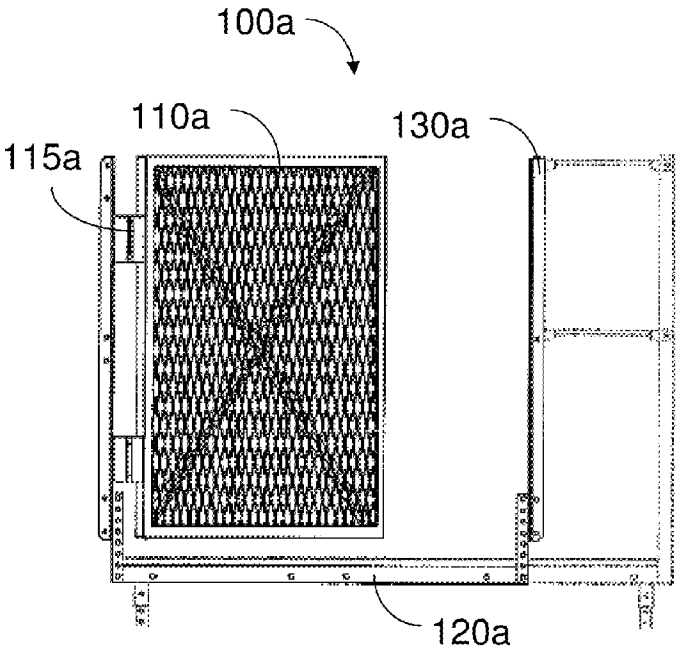

Gate systems may be hinged at either side of the gate body. FIGS. 19 and 20 depict illustrative embodiments of a left hand gate system 100*a* and a right hand gate system 100*b*. Each gate system has a gate 110*a* (110*b*), gate mounting bracket 120*a* (120*b*), gate attachment hinge 115*a* (115*b*), and gate rail post 130*a* (130*b*).

Figure 21:
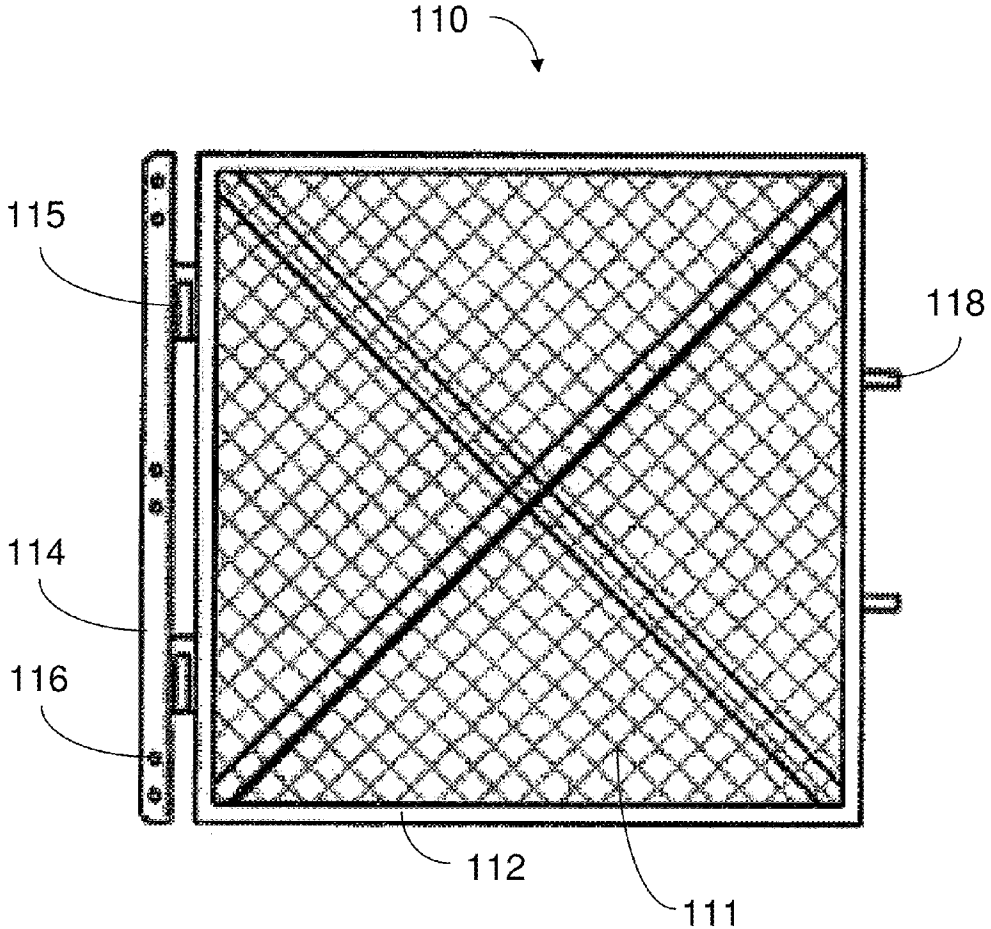
FIG. 21 is a side view of a gate in accordance with aspects of the invention.

FIG. 21 shows an illustrative embodiment of gate 110. The gate includes gate mesh 111 and rim 112 which includes much of the structure for which the entrance/exit of gate system 100 provides a barrier. It should be appreciated that the regions occupied by gate mesh 111 and gate rim 112 can be of any suitable design or structure. For instance, such regions are not required to have a mesh design. In fact, the gate mesh 111 and gate rim 112 regions may be, for example, solid, or may have paneled structure running horizontally, diagonally, and/or vertically. Gate 110 may include an attachment post 114 having hinges 115 and gate attachment regions 116. Gate body 110 may also include optional gate stop tabs 118, functioning to appropriately stop the gate when the gate is to be in a closed position. As discussed above, other suitable arrangements may be used for keeping the gate 110 closed.

Figure 22:
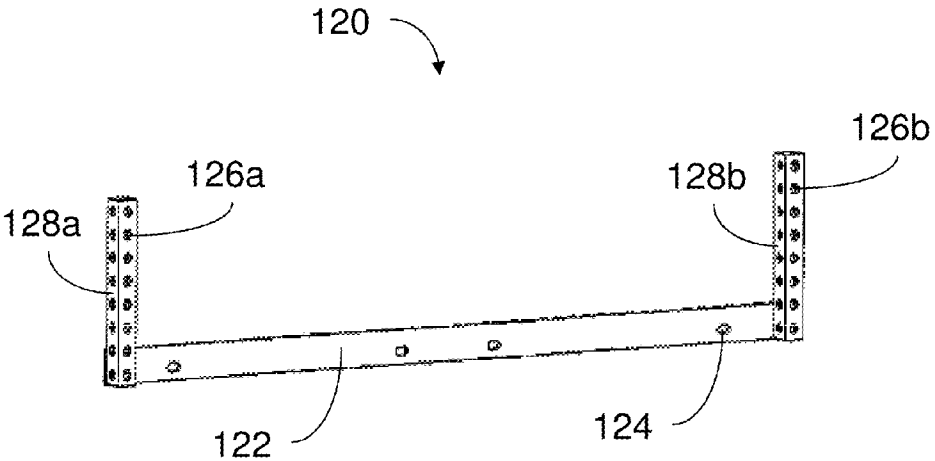
FIG. 22 is a perspective view of a gate mounting bracket in accordance with aspects of the invention.

FIG. 22 depicts a gate mounting bracket 120 for attaching the gate 110 to the platform 20. The gate mounting bracket 120 includes a main portion 122 having attachment regions 124 that facilitate mounting the bracket 120 on the platform 20. Gate mounting bracket 120 also includes side portions 128*a* and 128*b* having attachment regions 126*a* and 126*b*, respectively, that enable the gate to be attached to the mounting bracket 120. As not all side attachment regions are labeled, it should be appreciated that gate body 110 and gate rail post 130 may be attached at any appropriate location along side bracket portions 128*a* and 128*b*.

Figure 23:
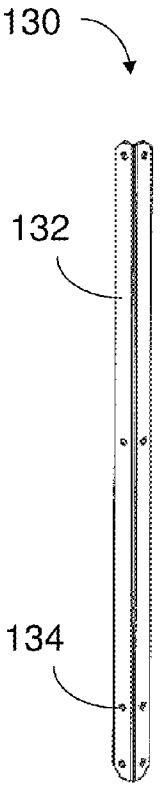
FIG. 23 is a side view of a gate rail post in accordance with aspects of the invention.

FIG. 23 shows a gate rail post 130. The gate rail post 130 includes body 132 and post attachment regions 134 and provides a complementary support on the opposite side of attachment post 114 of gate 110. The rail post 130 may be appropriately attached to the mounting bracket 120 at a side attachment region 126 and a rail post attachment region 134, as desired.

Figure 24:
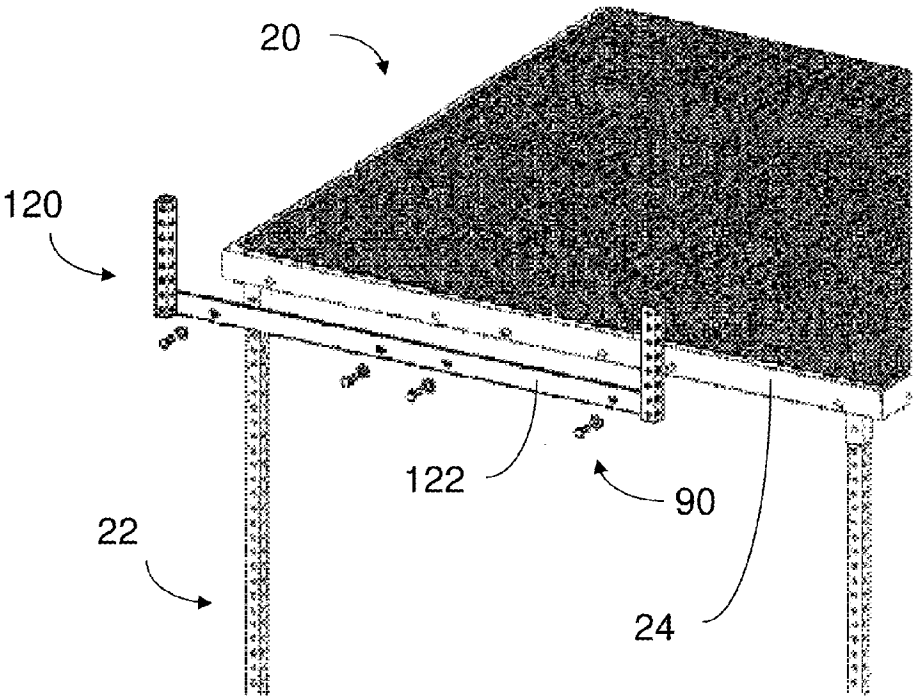
FIG. 24 is a perspective view of a gate mounting bracket being attached to a platform in accordance with aspects of the invention.

FIG. 24 depicts an illustrative embodiment of a gate mounting bracket 120 being attached to a platform. Main bracket portion 122 is placed immediately adjacent to, for example, a front edge 24 of platform 20 and attachment method 90 is used to attach the mounting bracket 120 to the platform 20.

Figure 25:
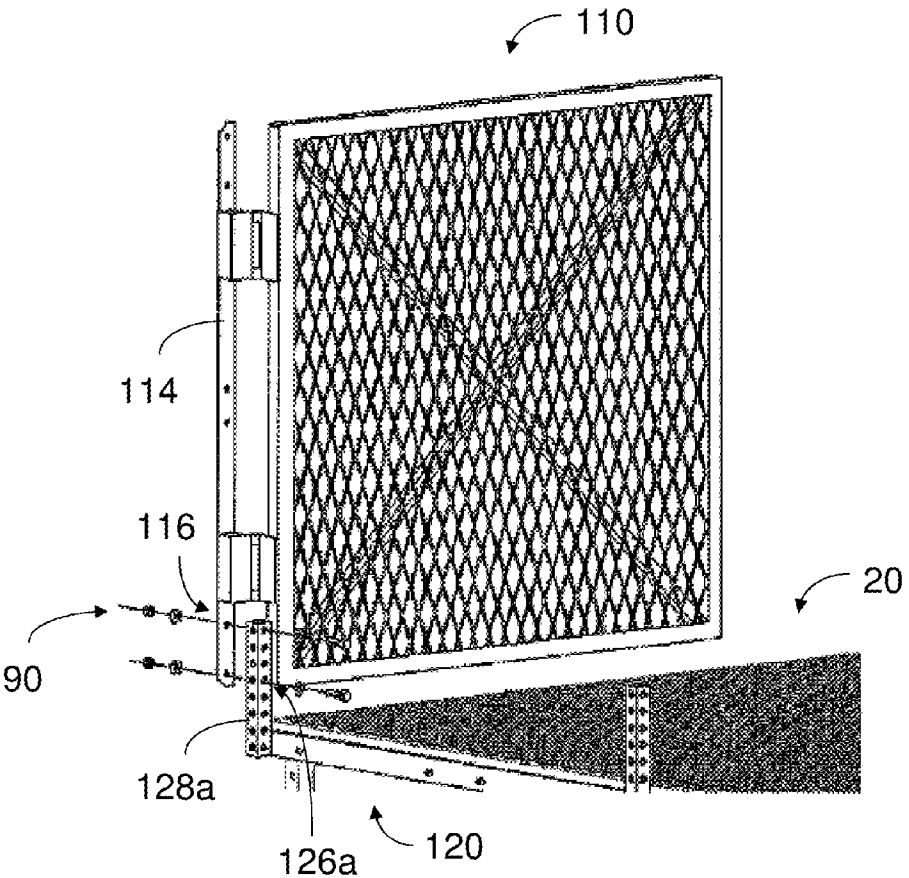
FIG. 25 is a perspective view of a gate being attached to a gate mounting bracket in accordance with aspects of the invention.
Figure 26:
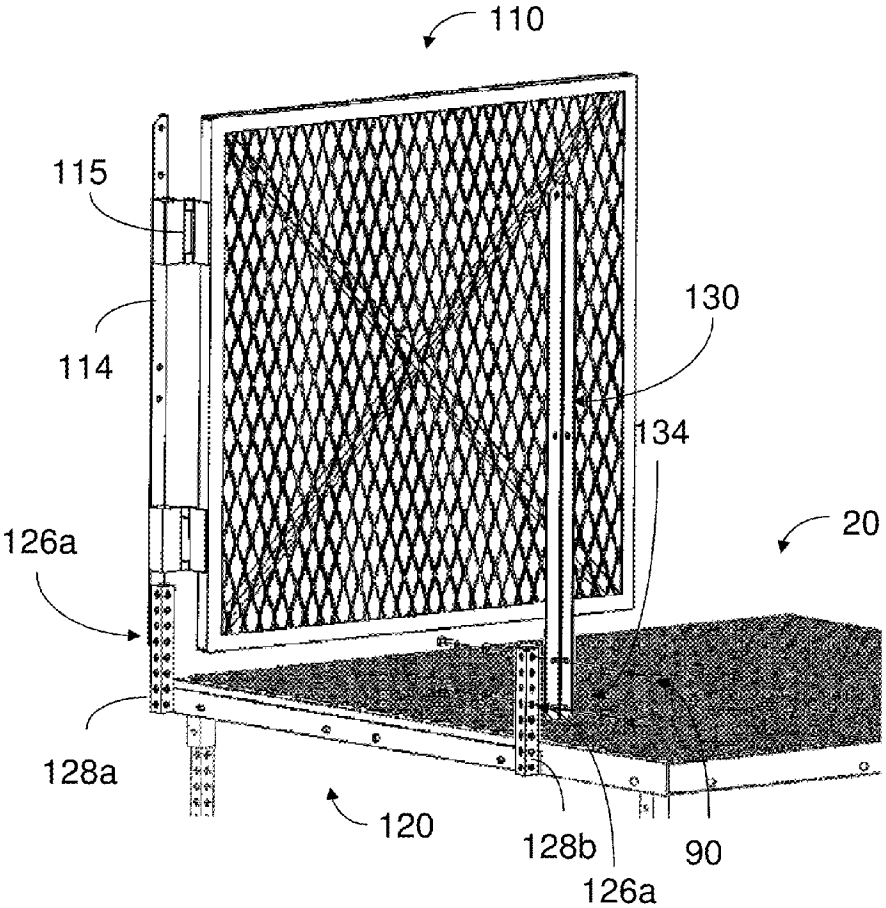
FIG. 26 is a perspective view of a gate rail post being attached to a gate mounting bracket in accordance with aspects of the invention.

Once the mounting bracket 120 is attached to platform 20, the gate 110 may then be attached to the mounting bracket 120, as shown in FIG. 25. Attachment post 114 of gate 110 is positioned with respect to a side gate bracket portion 128*a* such that gate attachment region 116 of the gate body 110 is appropriately aligned with side attachment region 126*a* of the gate mounting bracket 120. Attachment method 90 is then used to attach the gate 110 to the mounting bracket 120. Subsequently, gate rail post 130 may be appropriately positioned with respect to side bracket portion 128*b* so that the rail post attachment region 134 is appropriately aligned with side attachment region 126*b* of the mounting bracket 120, as shown in FIG. 26. Attachment method 90 may then be used to attach the gate rail post 130 to the mounting bracket 120.

Figure 27:
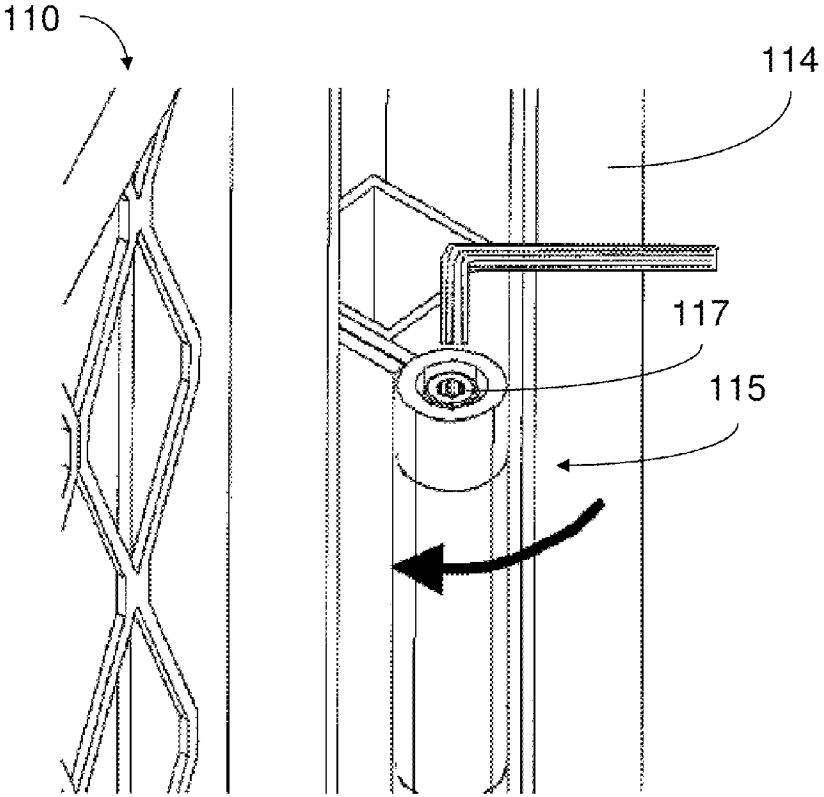
FIG. 27 is a fragmentary perspective view of a gate hinge in accordance with aspects of the invention.

Any appropriate hinge or pivot mechanism may be used as a gate attachment hinge 115 so as to open and close gate system 100. In an illustrative embodiment depicted in FIG. 27, gate attachment hinge 115 swivels about a hinge bolt 117 that may be tightened or loosened with a suitable hex tool. In some embodiments, hinge bolt 117 may be tightened or loosened by any appropriate method, such as a suitable screwdriver.

Having thus described several aspects of at least one embodiment of this invention, it is to be appreciated various alterations, modifications, and improvements will readily occur to those skilled in the art. It can be appreciated that any one or more of the components described herein may be formed of any suitable material or combination of materials such as, for example, plastic, wood, and/or metal. Such alterations, modifications, and improvements are intended to be part of this disclosure, and are intended to be within the spirit and scope of the invention. Accordingly, the foregoing description and drawings are by way of example only.

What is claimed is:

1. A reusable stair system for use with a platform comprising, a first set of legs having a first upper attachment region attached to the platform, the first set of legs extending downwardly from the platform and having base plates that are disposed on a surface on which the stair system is to be assembled;

a first stair having an upper surface, a front edge and a rear edge, the front edge having a front surface perpendicular to the upper surface and the rear edge having a rear surface perpendicular to the upper surface, the rear surface of the first stair being attached to a lower attachment region of the first set of legs at a first distance below the platform forming a first gap between the first stair and the platform;

a second set of legs having an upper attachment region attached to the front edge of the first stair, the second set of legs extending downwardly from the first stair and including base plates that are disposed on the surface on which the stair system is to be assembled;

a second stair having a front edge and a rear edge, the second stair being attached at the rear edge to a lower attachment region of the second set of legs at a distance below the first stair forming a second gap between the second stair and the first stair; and a third set of legs having an upper attachment region attached to front edge of the second stair, the third set of legs extending downwardly from the second stair and including base plates that are disposed on the surface on which the stair system is to be assembled;

wherein the first, second or third set of legs is spaced inward from a side edge of the first, second or third stair.

2. The stair system of claim 1, wherein at least one of the first, second, or third set of legs comprises at least one metal perforated leg.

3. The stair system of claim 1, wherein at least one of the first, second, or third set of legs comprises at least one base that is separately attached to a leg.

4. The stair system of claim 1, wherein at least one of the first, second, or third set of legs comprises a pair of legs.

5. The stair system of claim 1, wherein at least some of the sets of legs are made of mild steel or aluminum and are tubular or "L" shaped in cross section.

6. The stair system of claim 1, wherein the second stair comprises a lowermost stair.

7. The stair system of claim 1, further comprising a gate system arranged to provide access to the platform.

8. The stair system of claim 1, further comprising at least one additional stair having a front edge and a rear edge, said additional stair being attached at the rear edge to a lower attachment region of a previous set of legs at a distance below the previous stair; and at least one additional set of legs having an upper attachment region attached to the front edge of the at least one additional stair, the at least one additional set of legs extending downwardly from the at least one additional stair and including base plates that are disposed on the surface on which the stair system is to be assembled.

9. The stair system of claim 1, further comprising a ramp attached to the platform.

10. The stair assembly of claim 1, wherein the first set of legs are attachable and detachable at the first upper attachment region to the platform and at the lower attachment region to the first stair.

11. The stair assembly of claim 1, wherein the first upper attachment region includes at least one hole and the lower attachment region includes at least one hole.

12. The stair assembly of claim 1, wherein the first stair is attached only to the first set of legs and the second set of legs.

13. A reusable stair assembly comprising, a platform having a surface for access by the stair assembly;

a first set of legs having an upper attachment region attachable to a side of the platform for access by the stair assembly and extending downwardly to a ground surface from which access occurs, said first set of legs including bases that are disposed on the ground surface;

a first stair having a front edge and a rear edge, the rear edge of the first stair being detachably connected to a lower attachment region of the first set of legs at a distance below the platform forming a first gap between the first stair and the platform; and at least one additional set of legs having an upper attachment region attachable to a front edge of at least one additional stair as described in connection with the first stair above, wherein the at least one additional stair comprises a lowermost stair disposed within stepping access of the ground surface; and wherein the first or additional set of legs is spaced inward from a side edge of the first or additional stair.

14. The stair assembly of claim 13, wherein at least one of the sets of legs are "L" shaped cross section.

15. The stair assembly of claim 13, wherein the base of at least one of the sets of legs is separately formed and attached to a leg.

16. The stair assembly of claim 13, wherein at least one of the sets of legs is tubular metal of rectangular cross section.

17. The stair assembly of claim 16, wherein at least one of the sets of legs comprises one pair of legs.

18. The stair assembly of claim 16, wherein the legs and stairs are made of aluminum or steel.

19. The stair assembly of claim 18 wherein the legs are either tubular or L-shaped.

* * * * *